United States Patent [19]

Misumi et al.

[11] Patent Number: 5,048,496

[45] Date of Patent: Sep. 17, 1991

[54] FUEL INJECTION SYSTEM FOR ENGINE AND METHOD FOR INJECTING FUEL

[75] Inventors: Masanori Misumi, Hiroshima; Michihiko Tabata, Ohtake, both of Japan

[73] Assignee: Mazda Motor Corporation, Hiroshima, Japan

[21] Appl. No.: 554,911

[22] Filed: Jul. 20, 1990

[30] Foreign Application Priority Data

Jul. 20, 1989 [JP] Japan ..... 1-188021

[51] Int. Cl.[5] ..... F02D 9/00; F02M 47/00

[52] U.S. Cl. ..... 123/531; 123/585; 239/510; 239/511

[58] Field of Search ..... 123/585, 531, 532, 533; 239/408, 410, 411, 416.2, 533.2

[56] References Cited

U.S. PATENT DOCUMENTS

| | | | |
|---|---|---|---|
| 1,411,108 | 3/1922 | Kastler | 239/408 |
| 1,589,982 | 6/1926 | Muller | 123/533 |
| 1,609,386 | 12/1926 | Streeter | 123/533 |
| 1,901,848 | 3/1933 | Moore | 123/531 |
| 4,715,540 | 12/1987 | Miyake | 239/533.3 |
| 4,982,716 | 1/1991 | Takeda et al. | 123/531 |

FOREIGN PATENT DOCUMENTS 57-33253 2/1982 Japan .

57-108460 7/1982 Japan .

*Primary Examiner*—Andrew M. Dolinar
*Assistant Examiner*—M. Macy
*Attorney, Agent, or Firm*—Fleit, Jacobson, Cohn, Price, Holman & Stern

[57] ABSTRACT

A fuel injection system of an internal combustion engine including air introducing passage device extending in one direction for introducing auxiliary air under pressure, annular fuel passage of a disc-like space extending radially outwardly from the air introducing means and substantially perpendicularly to the air introducing passage for introducing fuel for combustion, annular opening provided at inner end of the annular fuel passage for injecting the fuel into the auxiliary air flowing in the air introducing passage from position surrounding the auxiliary air flow at a right angle to the flowing direction of the auxiliary air so that the fuel is atomized to be mixed with the auxiliary air. The fuel from the fuel injecting means is substantially perpendicularly injected into the auxiliary air flow in the form of a thin membrane so that the atomization of the fuel can be effectively facilitated resulting in an improved combustion performance of the liquid fuel. Since an improved atomization of fuel can be obtained according to the present invention, it is not necessarily to use a higher pressure fuel pump resulting in a reduction of cost for the fuel pump.

9 Claims, 6 Drawing Sheets

FUEL INJECTION SYSTEM FOR ENGINE AND METHOD FOR INJECTING FUEL

BACKGROUND OF THE INVENTION

1. Field of the Invention

The present invention relates to a fuel injection system for an internal combustion engine and a method for injecting a fuel into the engine.

2. Description of the Prior Art

Japanese Patent Public Disclosure No. 57-108460, laid open to the public in 1982, discloses a conventional fuel injection system for mixing an auxiliary air with a fuel and injecting the mixture into an intake passage or a combustion chamber. The fuel injection system includes an intermittent fuel injection valve for making timed fuel injection into the intake passage and an axiliary air introducing passage for introducing auxiliary air for atomization in the vicinity of a nozzle section of the injection valve. The auxiliary air introducing passage is adapted to introduce the auxiliary air in synchronizm with the timed injection by the injection valve in terms of a solenoid valve as a gate valve so as to facilitate atomization of the fuel.

According to the above injection system, the auxiliary air is introduced around the fuel being injected by the intermittent injection.

However, this type of injection system introducing the axiliary air around the fuel being injected cannot accomplish fuel atomization enough to provide a desirable combustion.

SUMMARY OF THE INVENTION

It is therefore a primary object of the present invetion to provide a fuel injection system which can improve the atomization of the fuel introduced into engine.

It is another object of the present invention to provide a method for injecting the fuel by which the amtomization is effectively facilitated.

According to the present invention, in order to accomplish the above and other objects, there is provided a fuel injection system of an internal combustion engine comprising air introducing means extending in one direction for introducing auxiliary air under pressure, annular passage means of a disc-like space extending radially outwardly from the air introducing means for introducing fuel for combustion, annular opening means provided at inner end of the fuel annular passage means for injecting the fuel into the auxiliary air flowing in the air introducing means from position surrounding the auxiliary air flow at a right angle to the flowing direction of the auxiliary air so that the fuel is atomized to be mixed with the auxiliary air.

Preferably, the annular passage means is connected with a fuel injecting valve which intermittently supplies the fuel to the annular passage means.

Preferably, the air introducing means is constituted by a cylindrical passage which extends substantially on a central axis of the fuel injecting valve.

The air introducing means and the annular passage means are provided in an adapter mounted on a tip end of the fuel injecting valve. The air introducing means is connected with an air supply producing a relatively low air pressure but more than the atmospheric pressure.

The auxiliary air can be taken out from an intake passage upstream of throttle valve.

The annular opening means may take a configuration of annular slit surrounding the auxiliary air flow when introduced into the air introducing means.

In accordance with another aspect of the present invention, there is provided a method for injecting fuel into an internal combustion engine comprising steps of transmitting auxiliary air in the form of a cylindrical flow in one direction, injecting fuel into the cylindrical flow of the auxiliary air from a peripheral position at a right angle to the of the flow with a thin liquid menbrane so that the fuel is atomized to be mixed with the auxiliary air, and introducing the mixture of the auxiliary air and the fuel into the engine.

According to the preferred embodiment of the present invention, the fuel injecting condition may be changed in accordance with engine operating condition. For example, as the engine load is increased, the fuel injection can be made through a center nozzle located in the center of the auxiliary air flow in the same direction as the direction of the auxiliary air flow. For this purpose, the injecting system in accordance with the present invention is provided with a diaphragm device which is operated in accorance with the engine load to switch the fuel supply path between the annular slit and the center nozzle.

According to the present invention, the fuel from the fuel injecting means is substantially perpendicularly injected into the auxiliary air flow in the form of a thin membrane so that the atomization of the fuel can be effectively facilitated resulting in an improved combustion performance of the liquid fuel.

It will be also understood that since an improved atomization of fuel can be obtained according to the present invention, it is not necessarily to use a higher pressure fuel pump resulting in a reduction of cost for the fuel pump.

The above and other features of the present invention will become apparent from the following description in connection with the preferred embodiment taking reference with the accompanying drawings.

DESCRIPTION OF THE PREFERRED EMBODIMENTS

Figure 1:
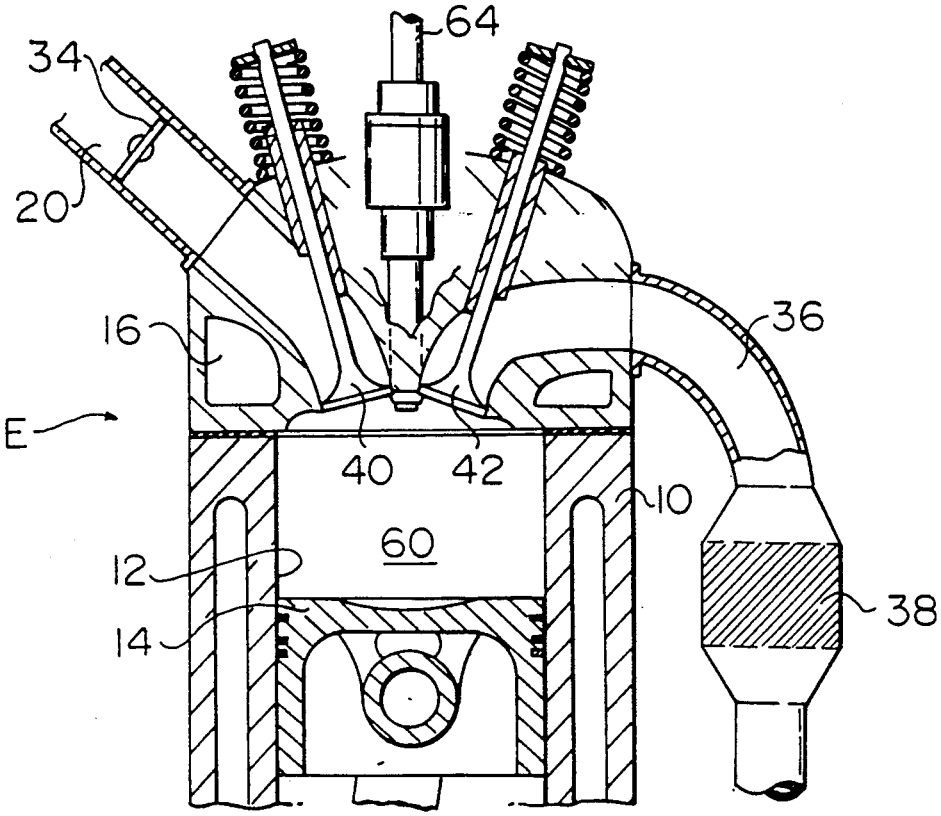
FIG. 1 is a schematic sectional view of an internal combustion engine to which the present invention can be applied.
Figure 2:
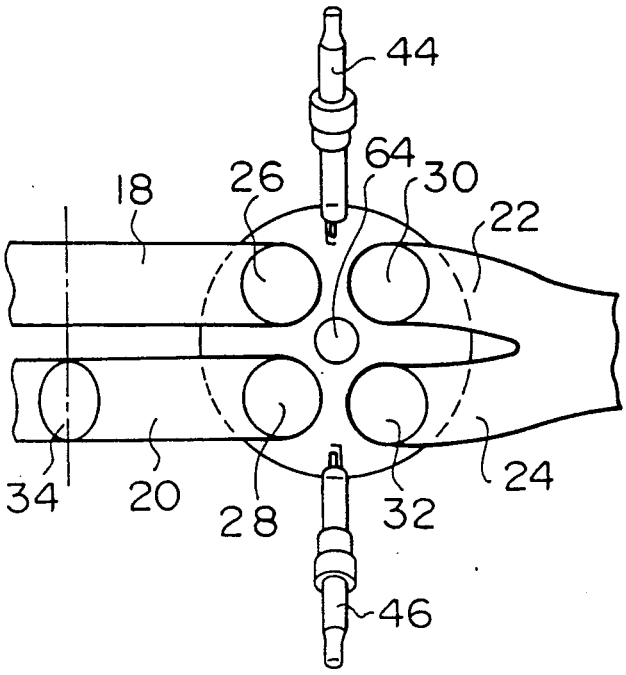
FIG. 2 is a schematic plan view of the engine of FIG. 1.
Figure 3:
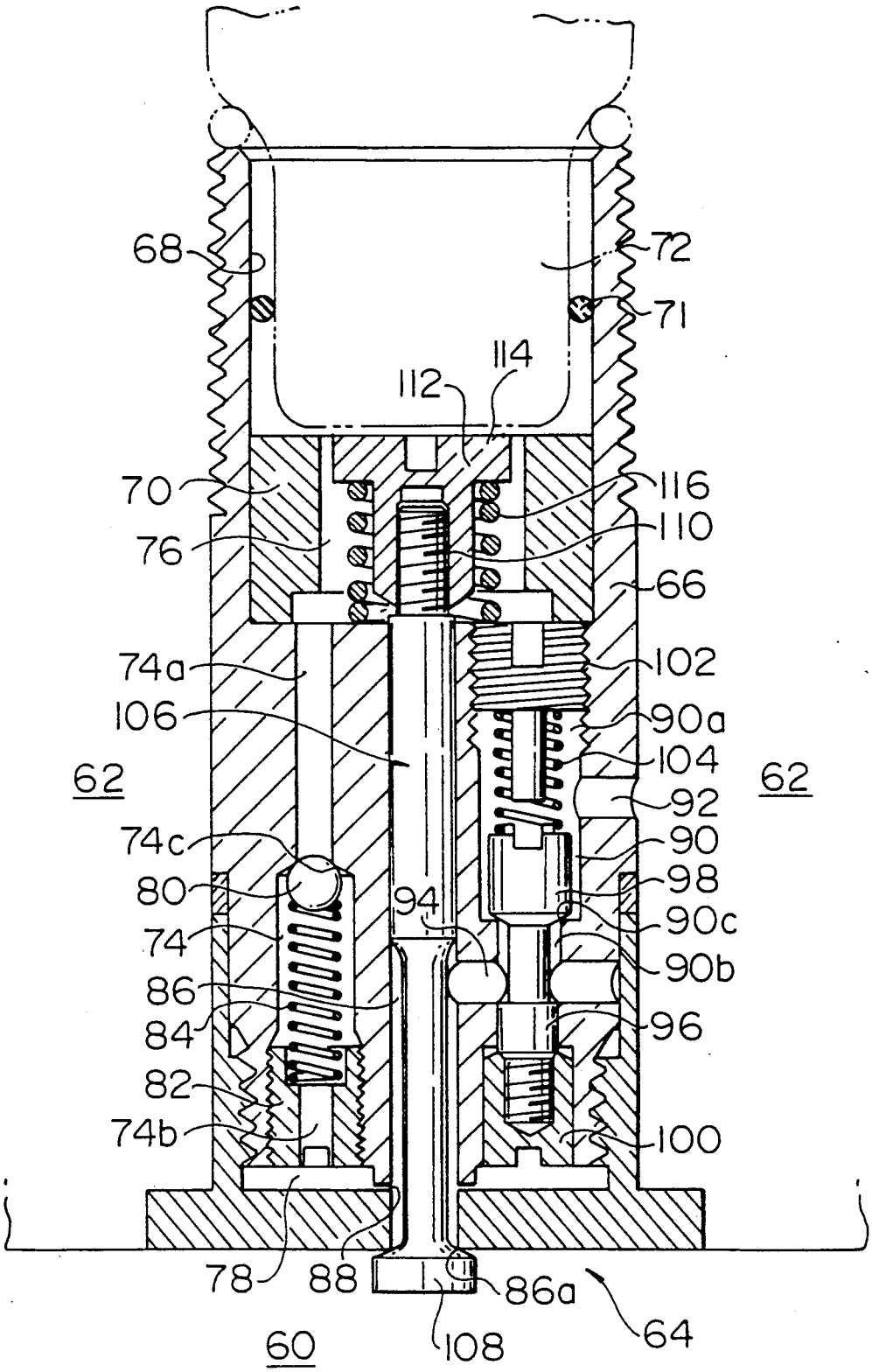
FIG. 3 is a sectional view of a fuel injection system in accordance with the present invention.

Referring to FIGS. 1 through 3, there is shown a fuel injection system according to a preferred embodiment of the present invention.

As shown in FIG. 1, an internal combustion engine E is provided with a cylinder block 10 formed with a cylinder bore 12 in which a piston 14 is disposed for slidably reciprocating movement, and a cylinder head 16 joined with the cylinder block 10. A combustion chamber 60 is defined by an upper surface of the piston 14, the cylinder bore 12 and a lower surface of the cylinder head 16. As shown in FIG. 2, the illustrated engine E is provided with a pair of intake passages 18, 20 and a pair of exhaust passages 22, 24 are provided to be communicated with the combustion chamber 60 through ports 26, 28, 30 and 32. A swirl control valve 34 is provided in the intake passage 20 for controlling air flow to the combustion chamber 60 to thereby control strength of the swirl of intake gas. The exhaust passages are converged in a downstream portion to form a single exhaust passage 36 in which a catalytic converter 38 is disposed for cleaning the exhaust gas.

An intake valve 40 and exhaust valve 42 are provided on the ports 26 and 30 to control introduction of the intake gas into the combustion chamber 60 and scavenging of the exhaust gas from the chamber 60. Further, the illustrated engine E is provided with a pair of ignition plugs 44, 46 and a fuel injecting device 64 disposed to be exposed into the combustion chamber 60. The fuel injecting device 64 is arranged to be projected in substantially a center of the combustion chamber 60.

Referring to FIG. 3, a detailed structure of the injecting device 64 is illustrated in the form of a sectional view.

The injecting device 64 is provided with an adapter or socket 66 mounted on the cylinder head 12. The socket 66 is formed on a top surface thereof with a concave portion or recess 68 on which a fuel injecting valve 72 is inserted and mounted through a tubular spacer 70. A seal member of O-ring 71 is disposed between an inner surface of the concave portion or recess 68 of the socket 66 and an outer surface of the injecting valve 72.

The socket 66 is also formed with a vertical fuel passage 74 extending in an up and down direction in FIG. 3. The vertical fuel passage 74 is communicated with the injecting valve 72 at an upper end 74*a* thereof through a chamber 76 formed in the spacer 70 and with an annular cavity 78 formed in the socket 66 at a lower end 74*b*. In the vertical fuel passage 74 of the socket 66 is disposed a ball valve or one-way valve 80 which allows only a downward flow in FIG. 3. A tubular support member 82 is screwed into the fuel passage 74 from the lower end 74*a* to carry a spring 84 which urges upwardly the ball valve 80 against a stepped portion 74*c* formed at an intermediate portion of the passage to close the passage 74. A central passage 86 of a cylindrical configuration extending in the up and down direction is formed in the socket 66 along the central axis of the socket 66. A lower portion of the central passage 86 is communicated with the annular cavity 78 through an annular slit 88 which extends perpendicular to the central passage 86 in a manner of surrounding the passage 86. The annular slit 88 is thin with regard to a longitudinal direction of the central passage 86 and wide with regard to a circumferential direction of the central passage 86. In other words, the annular slit 88 has a disc like configuration with an annular opening to the central passage 86. The fuel injected from the injecting valve 72 is introduced into the annular slit 88 through the chamber 76, the vertical passage 74, the one-way valve 80 and the annular cavity 78 at a right angle to the longitudinal direction of the central passage 86.

The socket 66 is further formed with a vertical air passage 90 of a cylindrical configuration therein extending in the up and down direction or longitudinal direction of the central passage 86. The vertical air passage 90 is provided for introducing an auxiliary air for the fuel before the fuel is introduced into the combustion chamber 60. The air passage 90 is communicated with an air pump or air source (not shown) at an upper end portion 90*a* through a radial passage 92 and with the central passage at an intermediate portion 90*b* through another radial passage 94. Thus, the air from the air pump is introduced into the central passage 86 through the radial passage 92, the air passage 90 and the radial passage 94 to be injected thereto.

A pressure responsive valve 96 of a spool configuration is disposed in the air passage 90 for slidable movement therein in the up and down direction. The responsive valve 96 is provided at an upper portion with a valve body portion 98 of an enlarged cylindrical portion for changing a flow passage area of the passage 90 and at a lower end portion with a pressure receiving portion 100 which is subjected to a fuel pressure in the cavity 78. A support member 102 is screwed into an upper portion of the air passage to be fixed to the socket 66. There is provided a spring 104 between the valve body portion 98 and the support member 102 for urging the responsive valve 96 downwardly against a stepped portion 90*c* to close the air passage 90. In the central passage 86 is disposed a poppet valve 106 slidable in the longitudinal direction of the central passage 86. The poppet valve 106 is provided with a valve body portion 108 at a lower end. An upper end 110 of the poppet valve 106 is joined with a piston 112 disposed in the cylindrical chamber 76 defined by the spacer 70. The piston 112 is formed with a flange portion 114 at an upper end. There is provided a spring 116 between a lower surface of the flange portion 114 and an upper surface of the recess 68 for urging the poppet valve upwardly against the lower surface of the injecting valve 72 to close an opening 86*a* at a lower end for the combustion chamber 64 since the valve body portion 108.

In operation, when the fuel injection is ready to be made, the injecting valve 72 is actuated to inject the fuel so that the fuel pressure is applied to a top surface of the piston 112 to move downwardly. Thus, the poppet valve 106 is moved downwardly so that the body portion 108 of the valve 106 is also moved downwardly against a spring force of the spring 116 to open the central passage 86. Concurrently, the fuel pressure from the injecting valve 72 is applied to the pressure receiving section 100 of the lower end of the responsive valve 96 so that the responsive valve 96 is moved upwardly to increase the flow passage area of the air passage 90. Thus, the air from the air pump or the auxiliary air is introduced into the central passage for being injected into the combustion chamber 60 through the radial passage 92, the air passage 90 and the radial passage 94 with a cylindrical form of flow. On the other hand, the fuel from the injecting valve 72 is introduced and injected into the central passage 86 from the annular opening of the annular slit 88 through the chamber 76 of the spacer 70, the fuel passage 74, the annular cavity 78 and the slit 88. In this case the slit 88 is oriented perpendicular to the central passage 86 so that the fuel from the annular opening of the annular slit 88 is injected into the air flowing in the central passage 86 at a substantially right angle to the auxiliary air flow in the form of a thin liquid membrane.

According to the illustrated embodiment, the fuel from the injecting valve 72 is substantially perpendicularly injected into the auxiliary air flow in the form of a thin membrane so that the atomization of the fuel can be effectively facilitated resulting in an improved combustion performance of the liquid fuel.

It will be also understood that since an improved atomization of fuel can be obtained according to the present invention, it is not necessary to use a higher pressure fuel pump resulting in a reduction of cost for the fuel pump.

Hereinafter, there is described another embodiment of the present invention taking reference with FIGS. 4 and 5.

Figure 4:
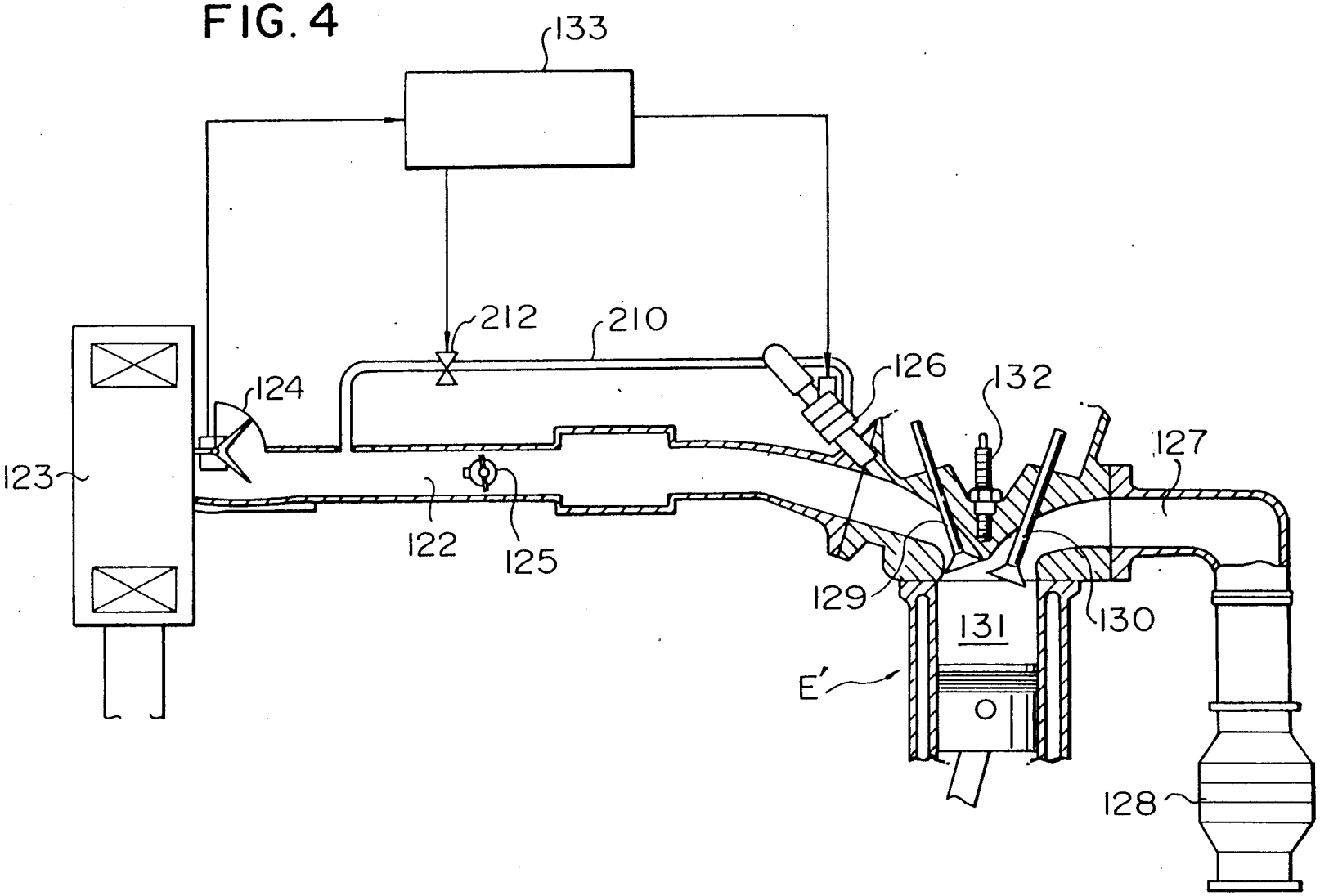
FIG. 4 is a schematic view of an internal combustion engine according to the present invention but showing another embodiment.

Referring to FIG. 4, an internal combustion engine E' is provided with an intake passage 122. The intake passage 122 is provided with an air cleaner 123 at an upstream end, an air flow meter 124 downstream of the cleaner 123, a throttle valve 125 and a fuel injection device 126 down stream of the throttle valve 125. The engine E' is also provided with an exhaust passage 127 with a catalytic converter 128. An intake valve 129 and an exhaust valve 130 is provided on intake and exhaust ports respectively for controlling communication of the intake and exhaust passages 122 and 127 with a combustion chamber 131. An ignition plug 132 is provided on cylinder head to be projected into the combustion chamber 131. The illustrated engine is provided with a controller 133 for controlling operation of the injection device 126.

Figure 5:
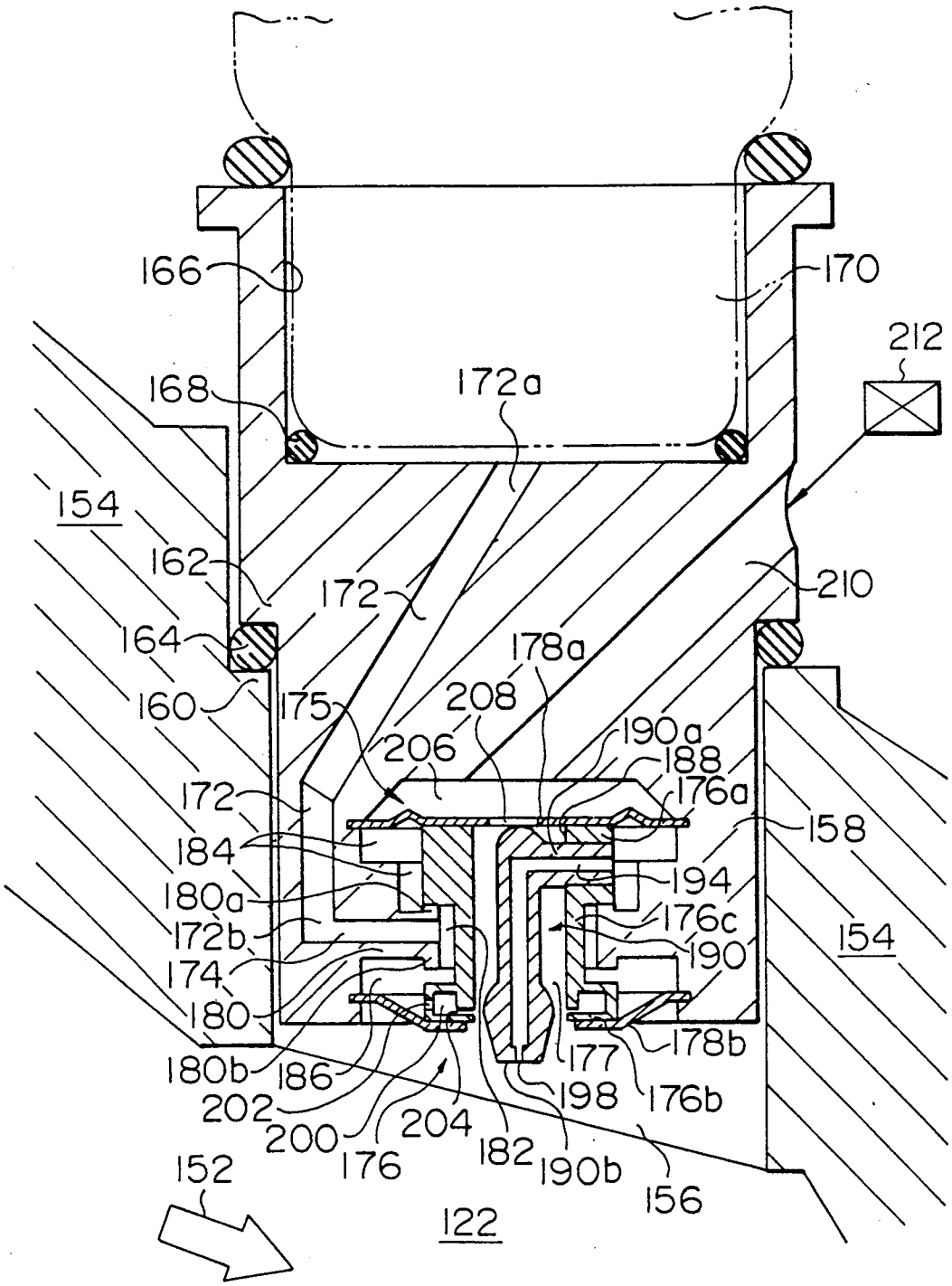
FIG. 5 is a sectiona view of a fuel injection in accorance with the embodiment of FIG. 4.
Figure 6:
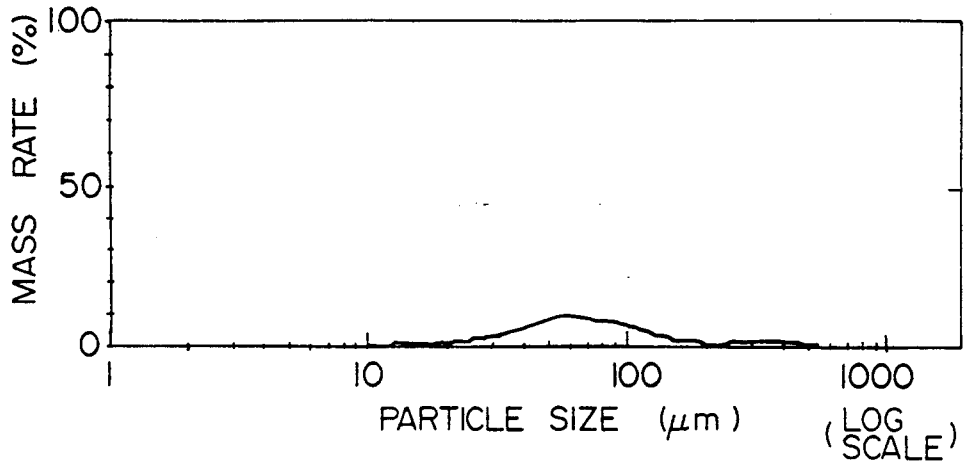
FIG. 6 is a graphical representation showing a test result for the ignition system of FIG. 3 in which the distribution of the fuel particle size is provided.

Referring to FIG. 5, there is shown a detailed illustration of the injection device 126 in the form of the sectional view.

In FIG. 5, the intake gas flows in the direction of an arrow 152. A housing 154 for mounting the injection device 126 is constituted by an intake manifold, intake tube and the like which defines the intake passage 122.

The housing 154 is formed with an opening 156 in which a socket or adapter 158 is inserted. The housing 154 is formed with an annular stepped portion 160. Likewise, the socket 158 is formed with an annular stepped portion 162 facing the stepped portion 160. Between the stepped portions 160 and 162 is disposed an O-ring 164 for sealing. The socket 158 is formed with a concave portion or recess 166 at a top end. A fuel injecting valve 170 is received in the recess 166 to be supported by the socket 158. There is also provided an O-ring 168 between the injecting valve 170 and the recess 166 of the socket for sealing. The socket 158 is formed with a fuel passage 172 extending oblique to a central axis of the injecting valve 170 substantially in the up and down direction in FIG. 5. The fuel passage 172 is communicated with the fuel injecting valve 170 at an upper end **172*a* and with a radial passage 174 extending radially at a lower end 172*b*. The socket 158 is further formed with a central passage 175 extending at a central portion of the socket 158 along the central axis. A tubular member 176 with a central and cylindrical bore 177 extending in the up and down direction is arranged in the central passage 175 and carried bewteen upper and lower diaphragms 178*a* and 178*b* which are supported by the socket 158 at the peripheral portions thereof. The tubular member 176 is provided with an upper annular portion 176*a* with an enlarged outer diameter, a middle annular portion 176*c* with a reduced outer diameter, and a lower annular portion 176*b* with an enlarged outer diameter. The upper, middle and lower annular portions 176*a*, 176*c* and 176*b*** have the same inner diameter.

The socket 158 is formed with an annular projection 180 projected in the central passage 175. The radial passage 174 is formed in the projection 180. The inner surface of the annular projection and the outer surface of the middle portion **176*c* of the tubular member 176 defines a middle annular space 182 in the central passage 175. The radial passage 174 is opened to be communicated with the middle annular space 182**.

There is formed an upper annular space 184 between the upper annular portion **176*a* and the inner surface of the socket 158 which defines the central passage 175. There is also formed a lower annular space 186 between the inner surface of the socket 158 and the lower annular portion 176*b*. In the illustrated state, the tubular member 176 is moved downwardly so that a stepped portion 176*d* formed between the upper and middle annular portions 176*a* and 176*c* is brought into contact with an upper annular surface 180*a* of the projection 180. Thus, the comunication between the middle annular space 182 and the upper annular space 184 are interrupted while the middle annular space 182 is communicated with the lower annular space 186. When the tubular member 176 is moved upwardly so that an annular stepped portion defined by the middle annular portion 176*c* and the lower annular portion 176*b* is brought into contact with a lower surface 180*b* of the projection 180, the middle annular space 182 is communicated with the upper annular space 184 while the communication between the middle annular space 182 and the lower annular space 186** is interrupted.

The tubular member 176 is formed at the upper annular portion **176*a* with a through hole 188 extending radially outwardly from the central bore 177 to be communicated with the upper annular space 184. There is provided an inversed L-shaped nozzle member 190 having a horizontal portion 190*a* extending radially outwardly at the upper end portion and vertical portion 190*b* extending downwardly along the central axis of the socket 158. The nozzle member 190 is inserted into the hole 188. The nozzle member 190 is formed with a fuel passage 194 therein communicated with the upper annular space 184 at one end and opened toward the intake passage 122 at the other end with the opening forming a nozzle tip 198. With this structure, the fuel introduced into the annular space 184 is injected from the nozzle tip 198 through the passage 194**.

There is defined an auxiliary air chamber 206 above the upper diaphragm **178*a* in the central passage 175. The chamber 206 is communicated with the central bore 177 of the tubular member 176 through an opening 208 formed on the upper diaphragm 178*a*. The air chamber 206 is also communicated with the intake passage 122 upstream of the throttle valve 125 through an auxiliary air passage 210 and a solenoid valve 212 which is controlled by the controller 133 as shown in FIG. 4**.

Thus, the auxiliary air is injected into the central bore 177 of the tubular member 176 through the intake passage 122, the auxiliary air passage 210, auxiliary air chamber 206 and the opening 208.

The tubular member 176 is formed with an annular chamber 200 in the lower annular portion 176*b*. The annular chamber 200 is communicated with the central bore 177 through an annular slit 204 at the inner end and with the lower annular space 186 through an opening 202 at the outer end.

With the above structure, when the engine load is low, the negative pressure due to the intake gas is relatively high so that there produces a greater value of pressure difference bewteen the intake passage 122 and the auxiliary chamber 206. As a result, the tubular member 176 is moved downwardly since the upper diaphragm 178*a* is displaced downwardly in FIG. 5. Consequently, the tubular member 176 is brought into contact with the upper surface 180*a* of the annular projection of the socket 158 to interrupt the communication between the upper annular space 184 and the middle annular space 182 with the middle annular space 182 being communicated with the lower annular space 186. Therefore, the fuel injected from the injecting valve 170 is introduced to be injected into the central bore 177 formed in the tubular member 176 through the passages 172 and 174, annular spaces 182 and 186, the opening 202, the annular chamber 200 and the annular slit 204.

The annular slit 204 is oriented substantially perpendicular to the central axis of the socket 158 or the direction along which the central bore 177 is extended. The slit 204 is thin with regard to the direction of the central axis of the socket 158 with being wide with regard to the radial direction. Accordingly, the fuel from the injecting valve 170 is eventually injected from annular opening of the slit 204 perpendicularly to the auxiliary air flow in the central bore 177 introduced from the intake passage 122 upstream of the throttle valve 125. This results in an improved atomization of the fuel and well mixed intake gas.

When the engine load is high, the negative pressure of the intake gas in the intake passage 122 is relatively low so that the pressure difference between the air chamber 206 and the intake passage 122. As a result, the tubular member 176 is moved upwardly to be contacted with the lower surface 180*b* of the projection 180 of the socket 158 so that the communication between the middle annular space 182 and the lower annular space 186 is interrupted with the middle annular space 182 being communicated with the upper annular space 184. Thus, the fuel from the injecting valve 170 is introduced to be injected from the nozzle tip 198 into the intake passage 122 through the passages 172 and 174, the annular spaces 182 and 184 and the passage 194. Therefore, when the engine load is high, the fuel is not injected through the slit 204 but through the nozzle tip 198.

There is shown a distribution curve of a fuel particle size in the case where the fuel injection system as shown in FIG. 3 is operated for performance test.

According to the test result, the average particle size is 43 μm (180 μm according to a conventional injection system). It will be understood that the atomization of the fuel is highly improved.

Figure 7:
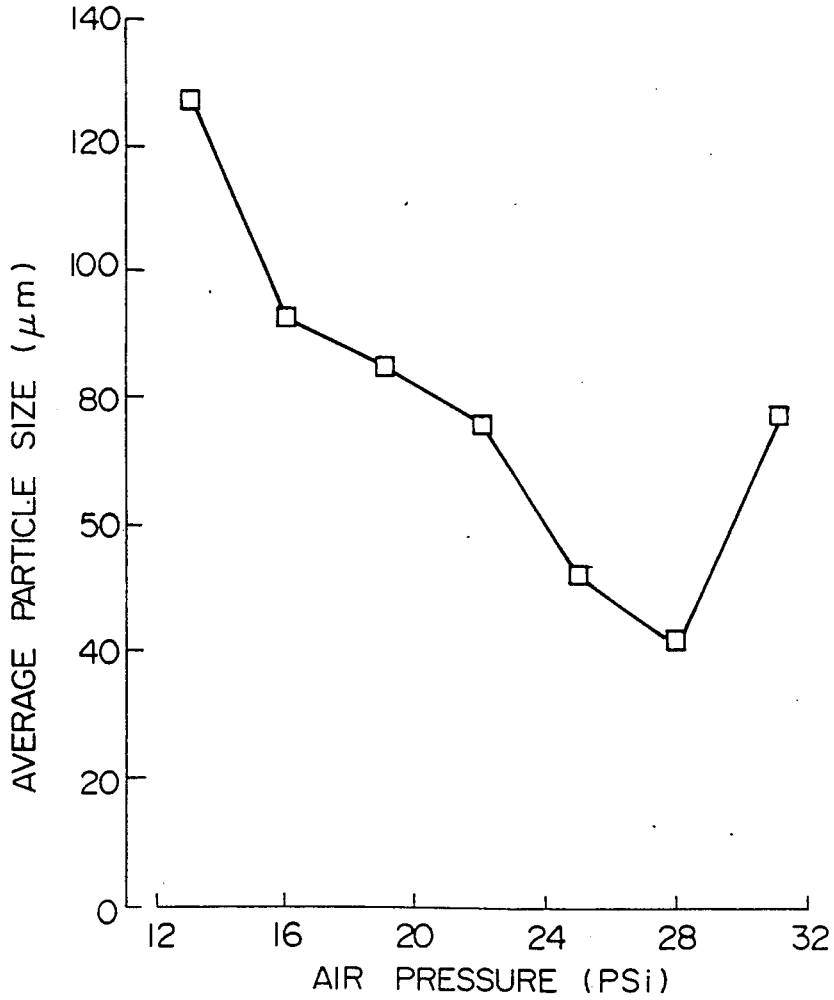
FIG. 7 is a graphical representation showing a relationship between an auxiliary air pressur and the fuel particle size.
Figure 8:
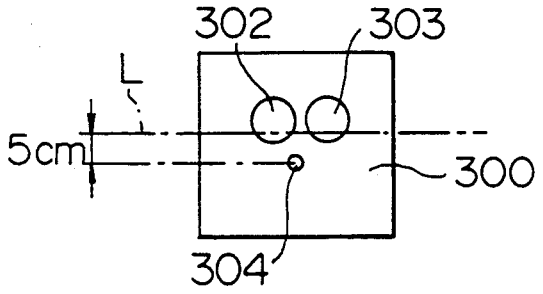
FIGS. 8 and 9 are schematic views showing a location of the measurements of the particle size of the fuel.
Figure 9:
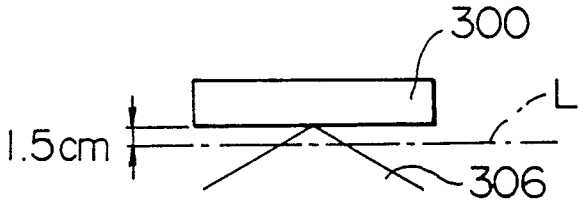

According to FIG. 7, there is shown a relationship between the auxiliary air pressure and the average particle size of the fuel when the injection system as shown in FIG. 3 is employed for testing. Referring to FIGS. 8 and 9, location where the particle size is measured is indicated. The measurement is made along a line L. The line L is 5 cm apart from the injection system 304 in a horizontal plane. Numerals 302, 303 and 300 denote exhaust valve, intake valve and cylinder head of the test device respectively. In this test device, the fuel is injected within a range shown by a numeral 306. The line is 1.5 cm apart from the lower surface of the cylinder head 300. As seen from FIG. 7, the average particle size of fuel is 43 μm at 28 PSi of auxiliary air pressure. On the other hand, in order to get 50 μm as the average fuel particle size in a conventional injection system, it is necessary to provide as much as 90 PSdi of the auxiliary air supply pressure. However, such a high supply pressure of the auxiliary air will increase the amount of the fuel adhered on the wall surface of the combustion chamber because the driving force of mixture of the fuel and air is increased. In this regard, the injection system can accomplish the improved atomization of the fuel with a relatively low pressure of the auxiliary air and a small amount of the fuel adhered on the wall surface of the combustion chamber.

Figure 10:
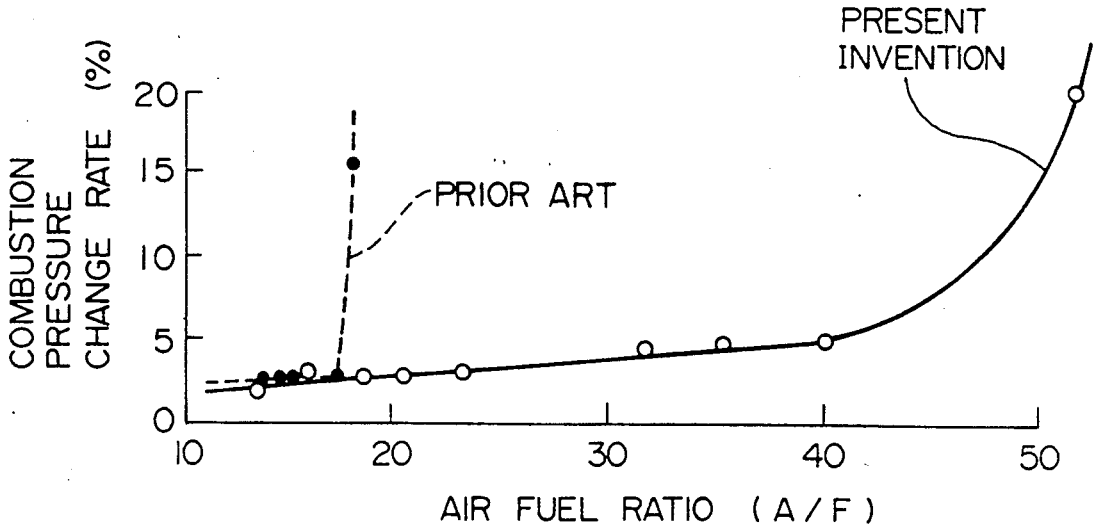
FIG. 10 is a graphical representation bewteen a combustion pressure change rate.

Referring to the FIG. 10, there is shown a relationship between the air fuel ratio (A/F) and a combustion pressure change rate. The combustion pressure change rate can be defined as a fluctuation rate of the maximum combustion pressure in the combustion chamber in one engine cycle. According to the ignition system of the present invention, the combustion change rate is stable against the change in the air fuel ratio at least until the air fuel ratio reaches about 50. On the contrary, in the conventional ignition system, the combustion pressure change rate is greatly fluctuated when the air fuel ratio exceeds about 18.

While the invention has been specifically described in connection with preferred embodiments thereof, it will be understood by the those skilled in the art that the foregoing and other changes or modifications in form and details can be made without departing from the spirit and scope of the invention, and that all of them will fall in the scope of the invention as claimed.

What is claimed is:

1. A fuel injection system of an internal combustion engine comprising air introducing means extending in one direction for introducing auxiliary air under pressure, annular passage means of a disc-like space extending radially outwardly from the air introducing means and substantially perpendicularly to the air introducing means for introducing fuel for combustion, annular opening means provided at inner end of the fuel annular passage means for injecting the fuel into the auxiliary air flowing in the air introducing means from position surrounding the auxiliary air flow at a right angle to the flowing direction of the auxiliary air so that the fuel is atomized to be mixed with the auxiliary air.

2. A fuel injection system as recited in claim 1 wherein the annular passage means is connected with a fuel injecting valve which intermittently supplies the fuel to the annular passage means.

3. A fuel injection system as recited in claim 2 wherein the air introducing means comprises a cylindrical passage which extends substantially on a central axis of the fuel injecting valve.

4. A fuel injection system as recited in claim 2 wherein the air introducing means and the annular passage means are provided in an adapter mounted on a tip end of the fuel injecting valve.

5. A fuel injection system as recited in claim 2 wherein the air introducing means is connected with air supply means for producing a relatively low air pressure but more than the atmospheric pressure.

6. A fuel injection system as recited in claim 1 wherein the auxiliary air is be taken out from an intake passage upstream of a throttle valve.

7. A fuel injection system as recited in claim 1 wherein the annular opening means is of annular slit surrounding flow of the auxiliary air flow in the air introducing means.

8. A fuel injection system as recited in claim 1 further comprising nozzle means for introducing the fuel into the engine instead of the annular opening means.

9. A fuel injection system as recited in claim 8 further comprising diaphragm means for switching introduction of the fuel into the engine between the nozzle means and the annular opening means in accorance with an ening load.

* * * * *